US005337908A

United States Patent [19]

Beck, Jr.

[11] Patent Number: 5,337,908

[45] Date of Patent: Aug. 16, 1994

[54] PATIENT HOIST

[76] Inventor: John R. Beck, Jr., 16371 Holly Dr., Fontana, Calif. 92335

[21] Appl. No.: 92,710

[22] Filed: Jul. 15, 1993

[51] Int. Cl.[5] ..... A61G 7/10

[52] U.S. Cl. ..... 212/189; 5/87.1; 104/126; 212/175; 212/205

[58] Field of Search ..... 212/175, 179, 180, 181, 212/182, 189, 205, 206, 208, 209, 218; 104/126; 248/188.4, 200.1, 644, 650; 5/87.1, 85.1; 414/921

[56] References Cited

U.S. PATENT DOCUMENTS

| | | | |
|---|---|---|---|
| 1,298,578 | 3/1919 | Schneider | 212/205 |
| 1,536,766 | 5/1925 | Cammann . | |
| 1,546,700 | 7/1925 | Allen et al. | 5/85.1 |
| 2,368,390 | 1/1945 | Winter . | |
| 2,437,486 | 3/1948 | Staiger | 212/205 |
| 3,469,360 | 9/1969 | Peterson et al. | 248/188.4 |
| 3,890,758 | 6/1975 | Bouchard | 248/650 |
| 4,243,147 | 1/1981 | Twitchell et al. . | |
| 4,627,119 | 12/1986 | Hackey et al. . | |
| 4,648,647 | 3/1987 | Patton | 212/182 |
| 5,072,840 | 12/1991 | Asakawa et al. . | |
| 5,158,188 | 10/1992 | Nordberg . | |

FOREIGN PATENT DOCUMENTS

| | | | |
|---|---|---|---|
| 307235 | 3/1929 | United Kingdom | 248/644 |

*Primary Examiner*—Michael S. Huppert

*Assistant Examiner*—Thomas J. Brahan

*Attorney, Agent, or Firm*—Sheldon & Mak

[57] ABSTRACT

Disclosed is a patient hoist for use in a room having a floor and at least one pair of parallel spaced walls at opposite sides of the floor. The hoist includes a frame having a pair of track beams and a pair of connecting beams, and a plurality of legs for supporting the frame elevated above the floor, four of the legs being corner legs having first and second beam engagement members extending therefrom for slidably engaging respective ones of the beams. Each corner leg is connected respectively to an end extremity of one track beam and an end extremity of one connecting beam for joining the beams. The connections between the corner legs and the beams are telescopically adjustable for locating at least one pair of the beams proximate the walls at opposite sides of the floor. A lift unit supported by the frame for lifting the patient includes a carriage beam having wheels for rollably supporting the carriage beam on the track beams, a lift carriage rollably supported for movement along the carriage beam, and a hoist unit supported by the carriage that has a depending retractable tension member for controllably lifting the patient. At least one pair of lateral support members projecting from opposite sides of the frame prevents horizontal movement of the frame in a direction perpendicular to the walls, and a spaced pair of the lateral support members contacts at least one of the walls for preventing plan rotation of the frame.

12 Claims, 3 Drawing Sheets

PATIENT HOIST

BACKGROUND

The present invention relates to invalid care, and more particularly to a patient hoist for facilitating movement to and from a bed, and for use in therapeutic exercises.

Many conventional patient lifts and exercise devices of the prior art have a frame that can be located in a hospital room or similar environment, one form of the frame having a rectangular cage configuration, with or without wheels, for enclosing a patient's bed or a larger portion of the room, a hoist being movable relative to the frame for lifting and transporting the patient. In another form of the frame, a cantilevered boom is supported for extending over the bed from one side or end thereof, a base portion of the frame being extendable beneath the bed. Such lifts are also used in home and hospice patient care.

A number of problems are associated with patient lifts of the prior art. For example, access to the patient is partially blocked by the frame, and movement of the patient is restricted due to interference by the bed and/or other room furniture with movement of the frame or because a stationary frame of the hoist covers only part of the room. Also, the hoist is subject to lateral instability that contributes to patient anxiety and aversion to use of the device. In the case of the cage-type frames, bracing for stiffening the frame further interferes with access to and movement of the patient, as well as with the placement of furniture within the room.

A further form of the patient lift frame of the prior art is supported by being fastened directly to ceiling and/or wall structure of the room. Unfortunately, significantly increased costs are associated with fastening the frame to structure of the room. Also, the direct mounting is objectionable in that the appearance of the room is adversely affected in the event that the lift is subsequently removed, particularly from a private residence.

Thus there is a need for a patient lift that provides free patient access and freedom of movement substantially throughout a room where it is used, while being structurally stable, without interfering with furniture placement or other activity within the room.

SUMMARY

The present invention meets this need by providing a patient hoist apparatus having a frame, legs for elevated support of the frame above the floor level, the frame supporting a lift unit for lifting the patient, and oppositely projecting lateral support members for preventing horizontal movement of the frame toward or against parallel spaced walls of a room using the apparatus, the lateral support members being adjustably spaced for simultaneously contacting the walls.

The lift unit can be horizontally movable relative to the frame over an area of the floor. The frame can be rectangular, having a parallel spaced pair of track beams for movably supporting the lift unit and a parallel spaced pair of connecting beams, four of the legs being corner legs, each corner leg being connected respectively to an end extremity of one track beam and an end extremity of one connecting beam for joining the beams. Preferably at least some connections between the corner legs and the beams are telescopically adjustable for locating at least one pair of the beams proximate the walls at opposite sides of the floor. Each of the corner legs preferably has orthogonally oriented first and second rigidly horizontally projecting beam engagement members extending therefrom for slidably engaging respective ones of the beams. A pair of set screws can be threadingly supported proximate the respective end extremities of each of the beams for adjustably clamping each of the corner legs, the set screws engaging corresponding ones of the beam engagement members.

At least two of the legs are side legs, each of the track beams being supported between the end extremities thereof by at least one of the side leg. At least one of the lateral support members adjustably projects from the frame.

The lift unit can include a carriage beam having wheels at opposite ends thereof for rollably supporting the carriage beam on the track beams, a lift carriage rollably supported for movement along the carriage beam, and a hoist unit supported by the carriage and having a depending retractable tension member for controllably lifting the patient. The frame can include portions of at least some of the leg.

Preferably the apparatus can include a spaced pair of the lateral support members contacting at least one of the walls for preventing plan rotation of the frame relative to the walls. The room can have four rectangularly disposed walls at opposite sides of the floor, each of the walls being contacted by at least one of the lateral support members for holding the frame in a fixed horizontal position. A spaced pair of the lateral support members can contact at least one of the walls for preventing plan rotation of the frame relative to the walls.

DRAWINGS

These and other features, aspects, and advantages of the present invention will become better understood with reference to the following description, appended claims, and accompanying drawings, where:

DESCRIPTION

Figure 1:
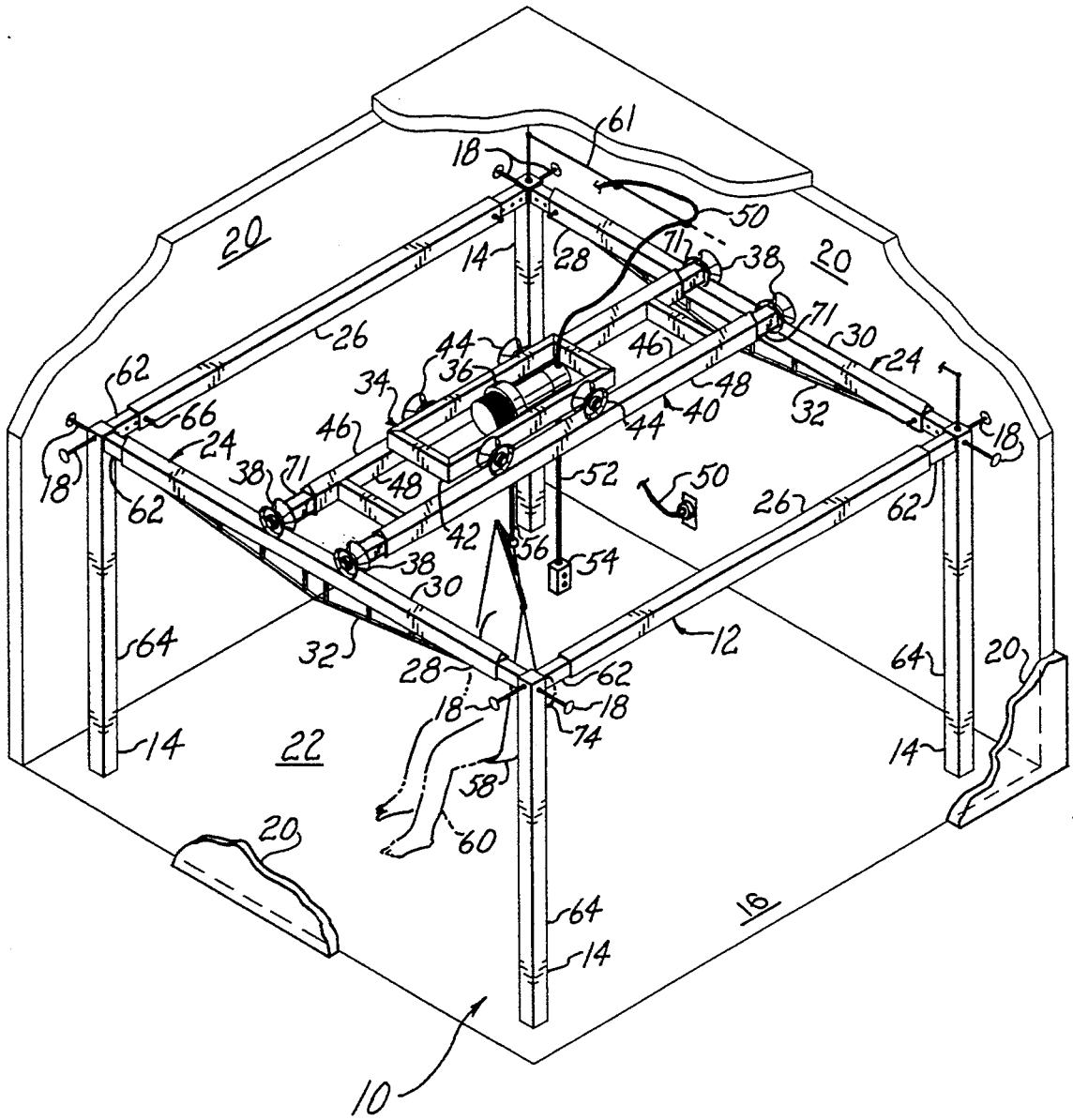
FIG. 1 is an oblique elevational perspective showing a patient hoist supported within a room and laterally stabilized against the walls of the room according to the present invention.
Figure 2:
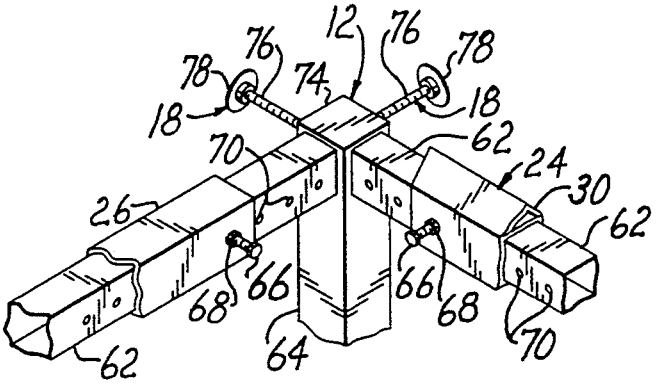
FIG. 2 is a detail perspective inside view of a portion of the hoist of FIG. 1 within region 2 thereof.
Figure 3:
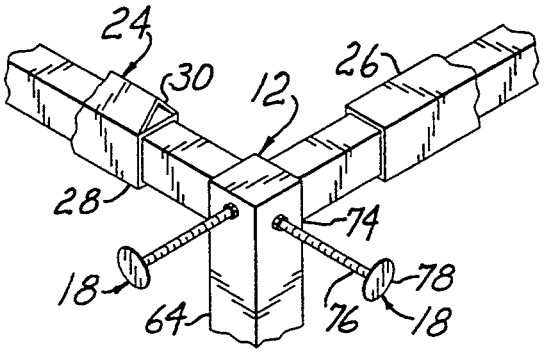
FIG. 3 is a detail perspective outside view of the hoist portion of FIG. 1.

The present invention is directed to a patient hoist that is particularly effective for transporting an invalid patient into and out of a bed, and within a room which can be a hospital room, a bedroom of a private residence or the like. With reference to FIGS. 1–3 of the drawings, a hoist apparatus 10 has a frame 12 that is supported on legs 14 above a floor surface 16, the frame 12 being laterally supported by adjustable support members 18 that contact upstanding walls 20 of a room 22 according to the present invention as further described below.

The frame 12 includes a parallel spaced pair of track beams 24 and a parallel spaced pair of tubular connector beams 26. Each of the track beams 24 includes a tubular beam member 28, a track member 30, and a truss structure 32. A lift unit 34 having a hoist unit 36 is rollably supported on the track members 30 by a plurality of beam rollers 38, the beam rollers 38 being rotatably mounted at opposite ends of a carriage beam 40. The hoist unit 36 is mounted on a carriage 42 that is rollably supported relative to the carriage beam 40 on a plurality of carriage rollers 44 that are rotatably mounted to the carriage 42. The rollers 44 on opposite sides of the carriage 42 engage respective parallel spaced rail members 46 that extend between opposite ends of the carriage beam 40. As shown in the drawings, each of the track members 30 and the rail members 46 is tubular, having a A shaped cross-section. The carriage beam 40 includes a parallel spaced pair of tubular carriage beam members 48 that are located directly under respective ones of the rail members 46, the carriage beam members 48 as well as the beam members 28 and the connector beams 26 being rectangular in cross-section. The beam rollers 38 and the carriage rollers 44 are tapered from ends thereof for lateral stability on the respective track members 30 and the rail members 46.

The hoist unit 36 is electrically powered by means of a flexible power cord 50, a control cord 52 having a control box 54 depending from the hoist unit 36 for controlling the raising and lowering of a flexible cable 56 of the hoist unit 36, the cable 56 being connectable to a patient sling 58 for lifting and transporting a patient 60. A sidewire 61 movably supports intermediate locations of the power cord 50 over one of the track beams 24, opposite ends of the sidewire 61 being mounted to upper extensions by a pair of the legs 14.

According to the present invention, a preferred form of the frame 12 has the track beams 24 and the connector beams 26 connected at corners of the frame 12 by rigid beam engagement members 62 that project from four of the legs 14, designated corner legs 64. Preferably, the beam engagement members 62 telescopically engage respective ones of the connector beams 26 and the beam members 28 of the track beams 24, advantageously permitting adjustment of the frame 12 for locating the corner legs 64 proximate corners of the room 22 as described herein.

As shown in FIG. 2, an exemplary configuration of the frame 12 has a set screw 66 that threadingly engages a clamp boss 68 that rigidly projects from proximate each end of the connector beams 24 and the beam members 28 of the track beams 24 for clampingly engaging respective ones of the beam engagement members 62, a spaced plurality of dimples 70 being formed in each beam engagement member 62 for facilitating locking the corner legs 64 in desired predetermined positions relative to the track beams 24 and the connector beams 26. Similarly, the carriage beam 40 includes a plurality of extensible roller mount members 71 that telescopically engage opposite ends of the carriage beam members 48 for adjustably spacing the beam rollers 38 to match the spacing between the track members 30. Accordingly, the carriage beam members 48 are provided with counterparts of the clamp boss 68 for threadingly receiving counterparts of the set screws 66, and the roller mount members 71 can be formed with counterparts of the dimples 70 for facilitating clamping of the roller mount members 71 in positions corresponding to the extensions of the beam engagement members 62.

In further accordance with the present invention, an orthogonally oriented pair of the support members 18 adjustably threadingly engages respective support bosses 72 that rigidly project outwardly from an upper portion 74 of each corner leg 64 as shown in FIG. 3, the beam engagement members 62 and the upper portions 74 of corner legs 64 forming part of the frame 12. The clamp bosses 68 and the support bosses 72 can be suitably formed by drilling or punching respective clearance holes (not shown) in the structure from which the bosses 68 and 72 are to project, then welding threaded nuts onto the structure concentrically with the clearance holes. Each of the support members 18 normally includes a headed, threaded post 76 having an enlarged resilient cap 78 thereon for compressive engagement with the corresponding wall 20 without damaging same.

In setting up the patient hoist apparatus 10, the frame 12 is assembled by first inserting the beam engagement members 62 fully into respective connector beams 26 and the beam members 28 with the support members 28 fully retracted into the support bosses 72. Next, the beam engagement members 62 are extended outwardly for positioning the corner legs 64 proximate corner intersections of the walls 20; then the set screws 66 are tightened, preferably into ones of the dimples 70 for positively locking the corner legs 64 proximate the walls 20. Finally, the support members 18 are advanced outwardly from the frame 12 for compressingly engaging the walls 20, thereby positively laterally stabilizing the frame 12 against horizontal movement toward or away from each of the walls 20. As thus described, a spaced pair of the support members 18 engages each of the walls 20 for preventing plan rotational movement of the frame 12. Of course, a single spaced pair of the support members 18 engaging one of the walls 20 would provide some stability against plan rotation, particularly if a single oppositely projecting support member contacting the opposite wall 20 were to be located at an intermediate beam location. Preferably there are horizontally spaced pairs of the support members 18 compressingly engaging at least two of the walls 20.

Figure 4:
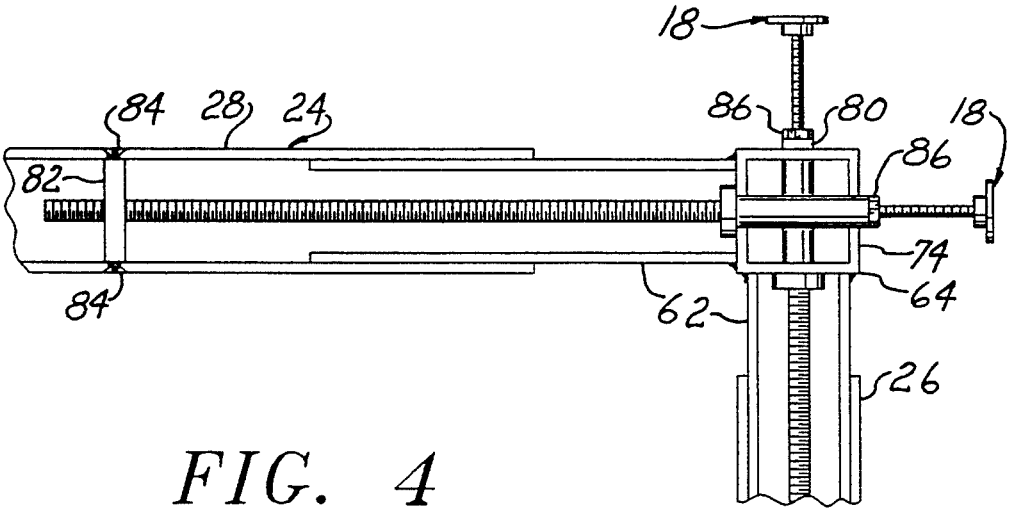
FIG. 4 is a fragmentary sectional plan view showing and alternative configuration of the hoist of FIG. 1.

With further reference to FIG. 4, an alternative configuration of the frame 12 has an orthogonal pair of adjustment bars 80 rotatably supported in the upper portion 74 of each corner leg 64, the adjustment bars 80 axially projecting from the beam engagement members 62 for threaded engagement with respective cross blocks 82 that are fixedly fastened by threaded fasteners 84 to the connector beams 26 and the beam members 28. Each of the adjustment bars 80 has wrench-engaging surfaces 86 that are accessible proximate outer surfaces of the corner legs 64, the support members 18 also axially threadingly engaging the adjustment bars 80.

In a preferred exemplary form of the frame 12, the beams 24 and 26, and the carriage beam members 48, are each slightly under nine feet in length, the corner legs 64 being extensible approximately 1.5 feet for use where the room 22 can be from 9×9 feet to 12×12 feet.

Figure 5:
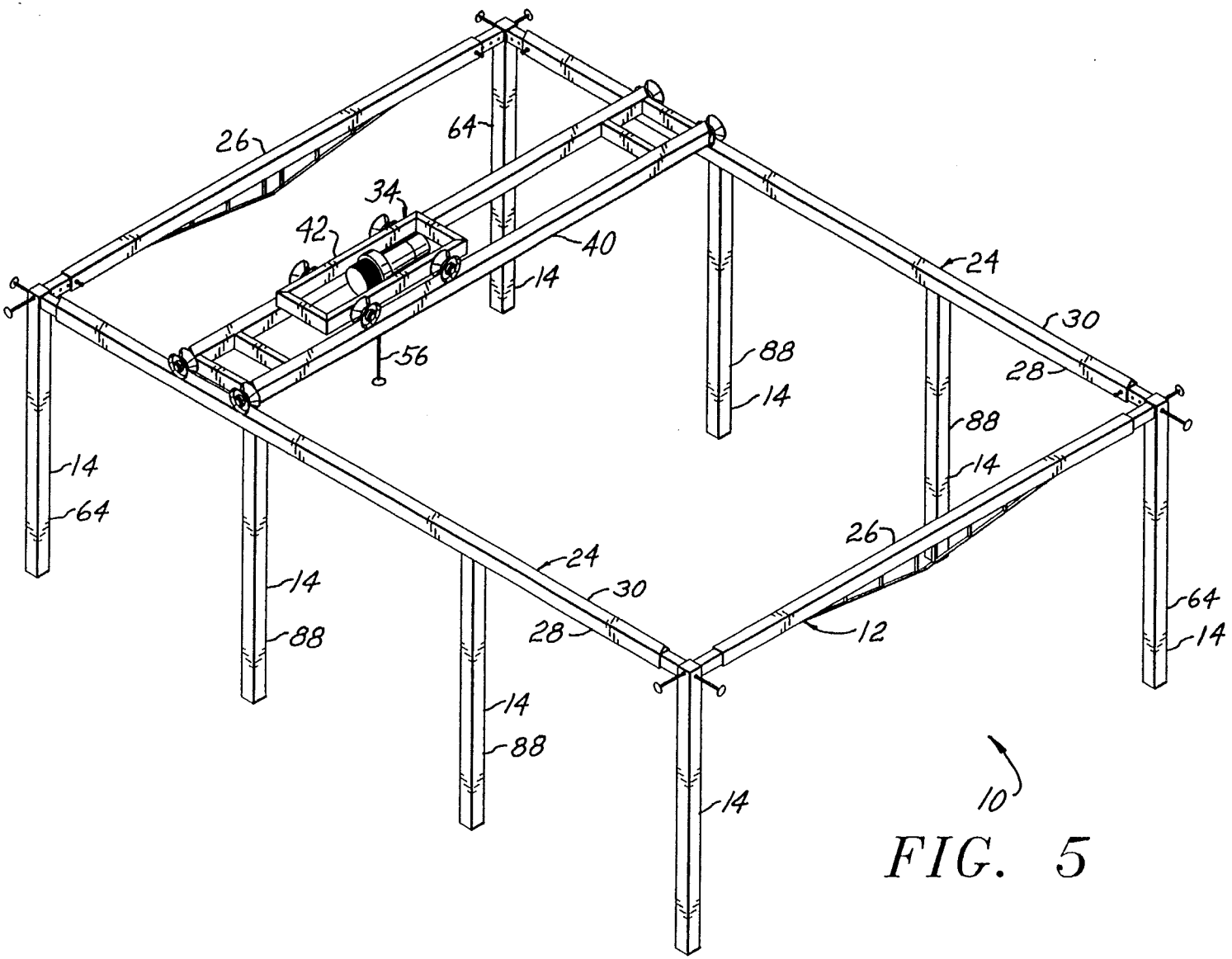
FIG. 5 is an oblique elevational perspective view of another alternative configuration of the hoist of FIG. 1.

With further reference to FIG. 5, the patient lift apparatus 10 of the present invention is adaptable for use when the room 22 is large, by using pairs of side legs 88 for providing additional support for the track beams 24. Also, the frame 12 is capable of being effectively horizontally stabilized by compressive engagement of a single horizontally spaced pair of the support members 18 against a single parallel spaced pair of the walls 20, horizontal movement of the frame 12 in a direction parallel to the walls 20 being prevented by frictional engagement of the support members 18 against the walls 20.

Although the present invention has been described in considerable detail with reference to certain preferred versions thereof, other versions are possible. For example, the support members 18 can be integrally formed with the adjustment bars 80 in the configuration of FIG. 5. Also the track members 30 can project beyond end extremities of the beam members 28, at least by the horizontal width of the corner legs 64, for extending the range of travel of the carriage beam 40. Similarly, the rail members 46 can project axially beyond the carriage beam members 48. Further, modular extensions of the track members 30 can be provided for use where the beam engagement member 62 project greatly beyond ends of the track members 30. Moreover, the corner legs 64 can have separate column members that axially engage sockets that are formed in the upper portions 74 for facilitating set-up in confined spaces. Therefore, the spirit and scope of the appended claims should not necessarily be limited to the description of the preferred versions contained herein.

What is claimed is:

1. A patient hoist apparatus for use in a room having a floor and four rectangularly disposed walls at opposite sides of the floor, the apparatus comprising:

(a) a horizontally disposed frame;

(b) a plurality of leg members for supporting the frame elevated about the floor;

(c) a lift unit supported by the frame for lifting the patient; and (d) a plurality of lateral support members horizontally projecting from opposite sides of a frame for preventing horizontal movement of the frame in a direction perpendicular to the walls, the lateral support members having substantially flat surfaces and being adjustably spaced for simultaneously contacting each of the four walls along the flat surfaces of the lateral support members without being fastened or mounted to the walls for holding the frame in a fixed horizontal position.

2. The apparatus of claim 1, wherein the lift unit is horizontally movable relative to the frame over an area of the floor.

3. The apparatus of claim 2, wherein the frame is rectangular, having a parallel spaced pair of track beams for movably supporting the lift unit and a parallel spaced pair of connecting beams, four of the leg members being corner leg members, each corner leg member being connected respectively to an end extremity of one track beam and an end extremity of one connecting beam for joining the beams.

4. The apparatus of claim 3, wherein at least some connections between the corner leg members and the beams are telescopically adjustable for locating at least one pair of the beams proximate the walls at opposite sides of the floor.

5. The apparatus of claim 4, wherein each of the corner leg members has orthogonally oriented first and second rigidly horizontally projecting beam engagement members extending therefrom for slidably engaging respective ones of the beams.

6. The apparatus of claim 5, further comprising a pair of set screws threadingly supported proximate the respective end extremities of each of the beams for adjustably clamping each of the corner leg members, the set screws engaging corresponding ones of the beam engagement members.

7. The apparatus of claim 3, wherein at least two of the leg members are side leg members, each of the track beams being supported between the end extremities thereof by at least one of the side leg members.

8. The apparatus of claim 2, wherein at least one of the lateral support members adjustably projects from the frame.

9. The apparatus of claim 2, wherein the lift unit comprises a carriage beam having wheels at opposite ends thereof for rollably supporting the carriage beam on the track beams, a lift carriage rollably supported for movement along the carriage beam, and a hoist unit supported by the carriage, the hoist unit having a depending retractable tension member for controllably lifting the patient.

10. The apparatus of claim 2, wherein a portion of the frame is integrally formed with at least one of the leg members.

11. The apparatus of claim 1, wherein each of the lateral support members includes a resilient contact for compressive engagement with the corresponding wall without damaging the wall.

12. A patient hoist apparatus for use in a room having a floor and four rectangularly disposed walls at opposite sides of the floor, the apparatus comprising:

(a) a horizontal disposed rectangular frame having a parallel spaced pair of track beams and a parallel spaced pair of connecting beams;

(b) a plurality of leg members for supporting the frame elevated above the floor, four of the leg members being corner leg members, each of the corner leg members having orthogonally oriented first and second rigidly horizontally projecting beam engagement members extending therefrom for slidably engaging respective ones of the beams, each corner leg member being connected respectively to an end extremity of one track beam and an end extremity of one connecting beam for joining the beams, at least some connections between the corner leg members and the beams being telescopically adjustable for locating at least one pair of the beams proximate the walls at opposite sides of the floor;

(c) a lift unit supported by the frame for lifting the patient, the lift unit being horizontally movable relative to the frame over an area of the floor, the lift unit comprising:

(i) a carriage beam having wheels at opposite ends thereof for rollably supporting the carriage beam on the track beams;

(ii) a lift carriage rollably supported for movement along the carriage beam; and (iii) a hoist unit supported by the carriage, the hoist unit having a depending retractable tension member for controllably lifting the patient; and (d) a plurality of lateral support members horizontally projecting from opposite sides of the frame for preventing horizontal movement of the frame in a direction perpendicular to the walls, the lateral support members having substantially flat surfaces and being adjustably spaced for simultaneously contacting each of the four walls along the flat surfaces of the lateral support without being fastened or mounted to the walls, for preventing plan rotation of the frame relative to the walls.

* * * * *